US005146984A

United States Patent [19]

Pleasants

[11] Patent Number: 5,146,984

[45] Date of Patent: Sep. 15, 1992

[54] EMERGENCY RELEASE DEVICE FOR CONNECTING BETWEEN TUBULAR MEMBERS IN OIL AND GAS WELLS

[75] Inventor: Charles W. Pleasants, Carrollton, Tex.

[73] Assignee: Otis Engineering Corporation, Carrollton, Tex.

[21] Appl. No.: 682,811

[22] Filed: Apr. 9, 1991

[51] Int. Cl.[5] ..... E21B 43/00

[52] U.S. Cl. ..... 166/238; 166/382

[58] Field of Search ..... 166/238, 239, 373, 378, 166/382

[56] References Cited

U.S. PATENT DOCUMENTS

| | | | |
|---|---|---|---|
| 3,999,901 | 12/1976 | Tschirky | 175/107 X |
| 4,441,559 | 4/1984 | Evans et al. | 166/382 |
| 4,473,122 | 9/1984 | Tamplen | 166/373 |
| 4,508,167 | 4/1985 | Weinberg et al. | 166/382 X |
| 4,510,995 | 4/1985 | Krause, Jr. et al. | 166/382 X |
| 4,823,872 | 4/1989 | Hopmann | 166/382 X |
| 4,949,791 | 8/1990 | Hopmann et al. | 166/378 |
| 4,986,362 | 1/1991 | Pleasants | 166/382 |

*Primary Examiner*—Thuy M. Bui
*Attorney, Agent, or Firm*—Warren B. Kice

[57] ABSTRACT

A device for connecting between two tubular members that are inserted in an oil and gas earth well in a manner to permit a quick release, yet prevent relative rotation between the tubular members. The device is adapted to pass fluid between the tubular member in their connected position.

18 Claims, 2 Drawing Sheets

30
34
34a
32i
44
43
36
42
34b
41
32b
36b
32g
36a
40a
32
38a
40a
32d
46'
32a
36c
3
4

34a'
34'
6
42
41
34b'
30'
32'
38a
36'
46

34
34c
44
32h
32
36

50

32c
38a
32d
38b
32e
36
32f

EMERGENCY RELEASE DEVICE FOR CONNECTING BETWEEN TUBULAR MEMBERS IN OIL AND GAS WELLS

BACKGROUND OF THE INVENTION

The present invention relates to a device for connecting between tubular members in oil and gas earth wells and, more particularly, to such a device which prevents relative rotation between the members and which can be easily and quickly released in the earth well.

In the operation of subterranean oil and gas earth wells, it is often necessary to perform several downhole operations in the well. Thus various types of operating tools have evolved which are sized to fit within well tubing or casing installed in the well. Traditionally, wireline has been used to connect the operating tools to equipment above ground to lower, set, and retrieve the operating tools into and from the well.

Reeled, or coiled, tubing is now being used in certain applications in place of the wireline since reeled tubing has several advantages. For example, reeled tubing does not rely on gravity for setting and retrieving the operating tools, but rather can traverse highly deviated, or horizontal, wells. Also, reeled tubing can be more rapidly inserted into the well and can be more easily passed through downhole equipment. Reeled tubing can also be used to convey fluids to the operating tool to hydraulically actuate the tool. Also, fluids such as water, foam, paraffin, corrosion inhibitors, spotting acid, cement, and the like, can be conveyed by the reeled tubing to the well for performing various functions including washing, cleaning and the like.

Emergency release devices are known which connect the reeled tubing to certain operating tools for providing a quick and reliable disconnect during emergency conditions, such as, for example, when the operating tool is jammed in the well. An emergency release device of this type is disclosed in U.S. Pat. No. 4,986,362 assigned to the assignee of the present invention.

The use of operating tools having at least one rotary component, such as progressive cavity transducers, are also used in downhole operations. These type of transducers usually consist of a helicoidal rotor which rotates relative to a helicoidal stator and can act as a pump to move fluid from an inlet to an outlet connection or as a motor to deliver rotary power at the end of the rotor for drilling or milling operations in the well.

However, if used with these type of rotary tools the emergency release device discussed above does not lock against rotation of the operating tool relative to the reeled tubing. Therefore, if the rotating component of the tool becomes jammed, one component of the emergency release device would rotate, or free-wheel, relative to the other. This makes it difficult to free the jammed rotary tool.

In a similar manner, hydraulic work-over units are often used in oil and gas earth wells to introduce tubing into the well for various operations including snubbing, recompletion, fishing and recovery-related services such as spotting cement, high intensity pumping and stimulation. In these operations, plural sections of relatively rigid tubing are connected and sequentially introduced into the well. In some of these situations it is necessary to apply a rotational force, or torque, to the tubular sections in the well, such as when drilling or milling packers, for example. Although it would be desirable to connect an emergency release device of the above type between two of the adjacent sections near the drilling end of the string, the sections above the emergency release device would free-wheel relative to the sections below the device when torque is applied t the former sections.

SUMMARY OF THE INVENTION

It is therefore an object of the present invention to provide a device for connecting between two tubular members for insertion in an oil and gas earth well.

It is further object of the present invention to provide a device of the above type which connects reeled tubing to a rotary tool.

It is a further object of the present invention to provide a device of the above type which connects the reeled tubing to the rotary tool in a manner to prevent both axial movement and rotary movement between the reeled tubing and the rotary tool.

It is a further object of the present invention to provide a device of the above type which permits the flow of fluid from the reeled tubing to the tool in the well.

It is a further object of the present invention to provide a device for connecting adjacent tubular sections in a hydraulic workover unit in a manner to transmit torque between the sections.

It is a further object of the present invention to provide a device of the above type which can be easily and quickly disconnected in the well.

Toward the fulfillment of these and other objects, the device of the present invention connects between two tubular members that extend in an oil and gas earth well in a manner to prevent both axial and rotational movement between the tubular members in the well. The device can quickly release the connection between the members in the well during emergency conditions.

DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
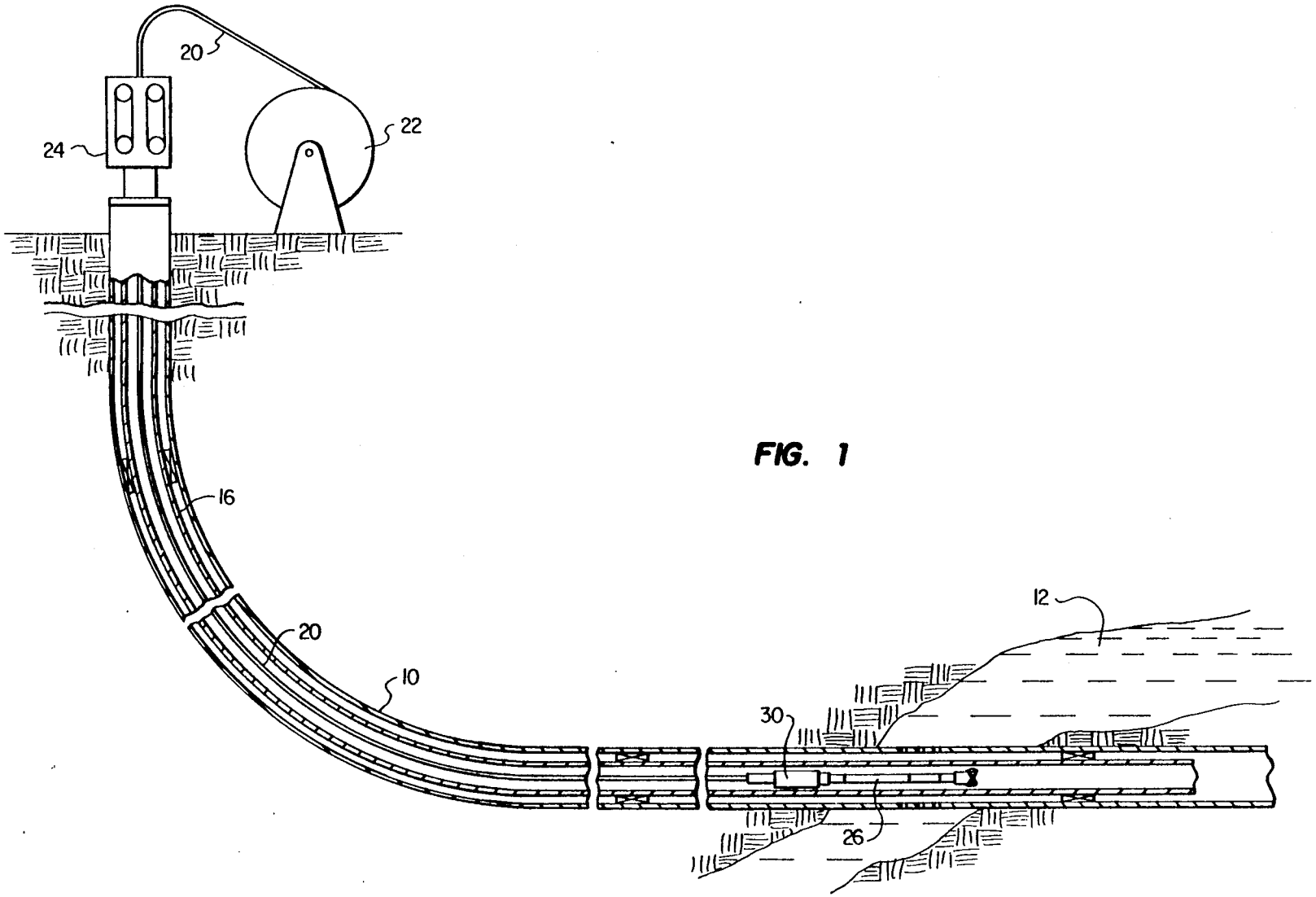
FIG. 1 is a schematic view, partially in elevation and section, and partially broken away, of a deviated earth well, showing the device of the present invention installed in a wellbore casing in the well.

Referring to FIG. 1 of the drawings, the reference numeral 10 refers to a casing passing through a formation 12 in a deviated earth well 14. A string of well tubing 16 is located in the casing 10 and extends in a coaxial relationship to the casing.

The device of the present invention will be described, by means of example, as being connected between reeled tubing and an operating tool. To this end, a section of reeled tubing 20 is stored on a reel 22 above ground and is injected into the casing 10 and the well tubing 16 by an injector 24. It is understood that a manifold (not shown) is provided which includes the necessary pumps, valves, and fluid reservoirs to discharge a fluid into and through the reeled tubing 20. It is also understood that a wellhead valve (not shown) is used to control vertical access to, and fluid communication with, the upper portion of the well tubing, and blowout preventers, or the like (not shown), can be installed to block fluid flow during emergency conditions. Since these components are conventional they will not be described in any further detail.

The reeled tubing 20 extends through a vertical section of the well tubing 16, through an angled or curved section and to a horizontal section. An operating tool 26 is also located in the horizontal section of the well tubing 16 and is connected to the distal end of the reeled tubing 20 by the connecting device of the present invention, which is referred to in general by the reference numeral 30. The tool 26 can be of any type of tool that includes a tubular member that is designed to be connected to reeled tubing, such as the reeled tubing 20. For example, the tool 26 can be a progressive cavity transducer of the type disclosed in U.S. Pat. No. 3,999,901, and includes an elongated tubular housing for receiving fluid under pressure which activates a rotor to deliver torque for rotating a drill bit, or the like. In the example shown, the tool 26 would be operated by the fluid received from the reeled tubing 20, via the connecting device 30.

Figures 2, 3, 4, 5, 6:
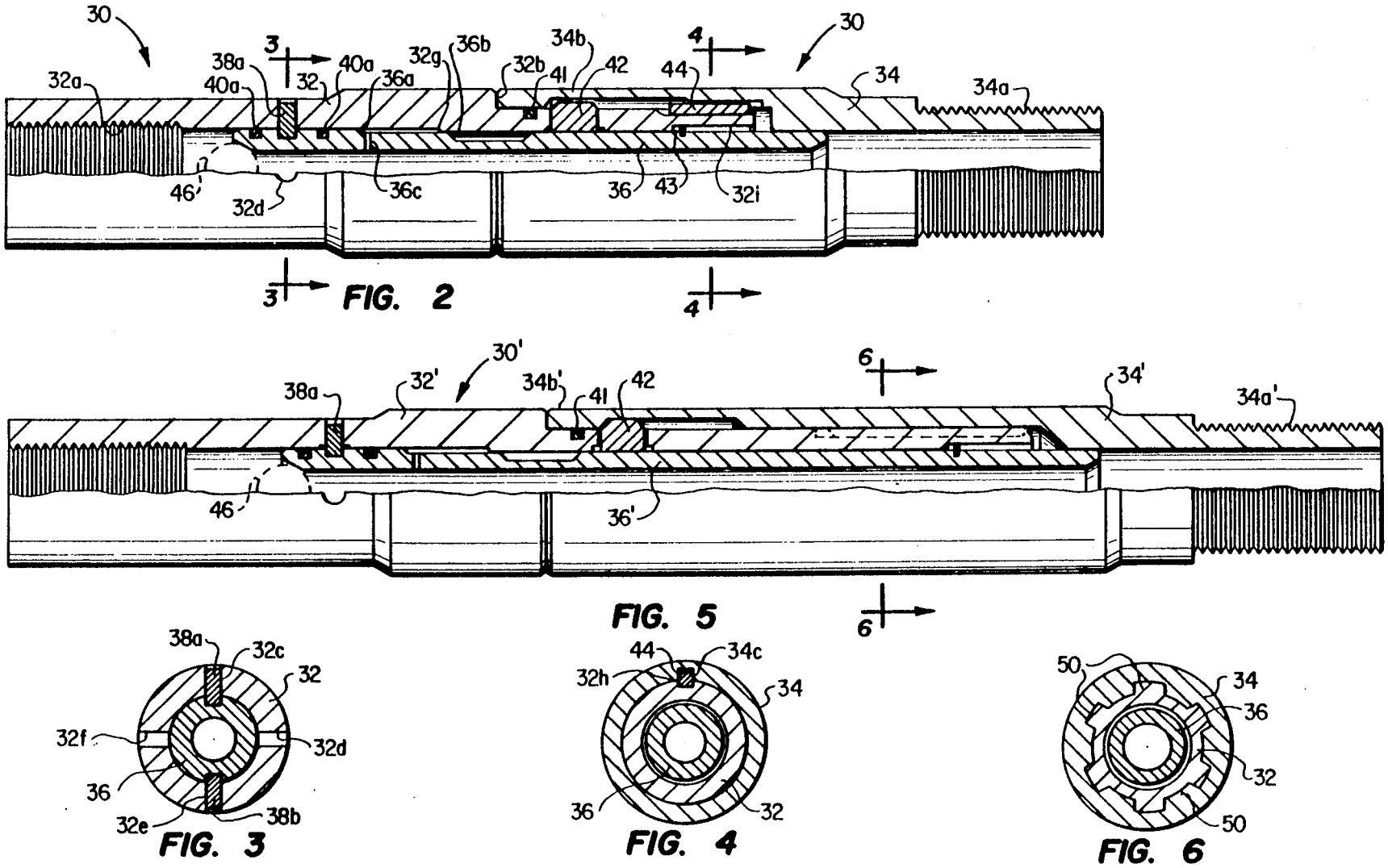
FIG. 2 is an enlarged, longitudinal cross-sectional view of the apparatus of the present invention.
FIGS. 3 and 4 are cross-sectional views taken along the lines 3—3 and 4—4, respectively, of FIG. 2.
FIGS. 5 and 6 are views similar to FIGS. 2 and 4, respectively, but depicting an alternate embodiment of the device of the present invention.

The device 30 is shown in detail in FIGS. 2 and 3 and comprises a sub 32 having an internally threaded end portion 32*a* for connecting to the reeled tubing 20, and a sub 34 coaxially aligned with the sub 32 and having an externally threaded end portion 34*a* for connecting to the tool 26. The sub 34 has a stepped inner diameter to form a fishneck 34*b* at its other end portion. The outer diameter of the sub 32 is stepped and defines a shoulder 32*b* which is engaged by the end of the fishneck 34*b* in the connected position of FIG. 2. A tubular prop 36 extends within the subs 32 and 34 and has an outer diameter slightly less than the diameters of the subs. The bore of the prop 36 connects the bore of the sub 32 to the bore of the sub 34 to define a continuous fluid flow passage.

As better shown in FIG. 3, four radially-extending openings 32*c*, 32*d*, 32*e*, and 32*f* are formed through the sub 32 and are spaced at 90 degree intervals. The openings 32*c* and 32*e*, which are spaced 180 degrees, receive shear pins 38*a* and 38*b*, respectively, which extend into an appropriate groove or notches in the prop 36 to secure the prop against axial movement relative to the subs 32 and 34. The openings 32*d* and 32*f* function to equalize fluid pressure across the sub 32, as will be described. The openings 32*c*–32*f* extend between two axially-spaced seal rings 40*a* and 40*b* disposed in external grooves in the prop 36.

The internal bore of the sub 32 and the external surface of the prop 36 are stepped to form two spaced shoulders 32*g* and 36*a*, respectively, and an enlarged groove 36*b* is formed in the outer surface of the prop 36 in a spaced relation to the shoulder 36*a*. An axially-extending weep opening 36*c* extends through the prop 36 and, in the connected position of FIG. 2, registers with the space between the shoulders 32*g* and 36*a* for reasons to be described. A seal ring 41 is provided in an external groove in the sub 32 and normally engages the inner surface at the fishneck 34*b*.

The flow passage defined by the two aligned bores of the subs 32 and 34 and the bore of the prop 36 receives fluid from the reeled tubing 20 and passes the fluid to the operating tool 26 connected to the sub 34 for actuating the operating tool. The fluid can also be used for cleaning and washing and, to this end, would pass through the reeled tubing 20 and the connecting device 30 and would be discharged through an opening in the operating tool 26 into the well tubing 16. The seal rings 40*a*, 40*b*, and 41 prevent fluid from escaping as it passes through the flow passage defined by the subs 32 and 34 and the prop 36.

A plurality of angularly-spaced retaining lugs 42, one of which is shown in FIG. 2, extend through corresponding openings in the sub 32. One end of each lug 42 extends flush with the bore of the sub 32 and is maintained in this position by engagement with the outer surface of the prop 36. The other end portion of each lug 42 projects outwardly from its opening where it is engaged by an internal shoulder formed on the fishneck 34*b* of the sub 34. Thus the sub 34, and therefore the operating tool 26 (FIG. 1), are connected to the sub 32 and therefore to the reeled tubing 20 in a manner to prevent axial movement therebetween. A retaining ring 43 is disposed in an angular groove formed in the external surface of the prop 36 and extends in a milled groove 32 formed in the inner surface of the sub 32 for reasons to be explained.

As better shown in FIG. 4, an axially-extending slot 34*c* is formed through the internal surface of the sub 34 and a complementary axially-extending slot 32*h* is formed through the external surface of the end portion of the sub 32. The slots 34*c* and 32*h* are aligned and together define a space having a substantially square cross-section which receives a bar, or stock, 44, having a similar cross-section. In assembly, the bar 44 is placed in the slot 34*c* formed in the sub 34 and the lugs 42 are placed in their corresponding openings in the sub 32. The fishneck 34*b* of the sub 34 is placed over the end of the sub 32 and the latter sub rotated until the slot 32*h* in the sub 32 aligns with, and receives, the bar 44. The sub 34 is then advanced further relative to the sub 32 until the free end of the fishneck 34*b* engages the shoulder 32*b* of the sub 32. The prop 36 is then advanced in the bore of the sub 32 and the bore of the sub 34 until it taken the position shown in FIG. 2. During this movement, the leading end of the prop 36 engages the lugs 42 and moves them radially outwardly to retain the internal shoulder of the fishneck 34*b* in the connected position shown in FIG. 2, and thus prevent any relative axial movement between the subs 32 and 34. The tool 26, and therefore the device 30 and the reeled tubing 20, is inserted in the tubing 16 in the well 14 and the reeled tubing is played out from the reel 22 until the tool attains a predetermined position in the well, such as shown in FIG. 1. If the tool 26 includes a rotating component of the type described above, the bar 44 transfers any torque from the sub 34 to the sub 32 and thus eliminates any free-wheeling between the subs in the event the tool becomes jammed.

In the event it is desired to disconnect the tool 26 from the reeled tubing 20 in the tubing 16 when, for example, the tool 26 becomes jammed, a ball 46 of a diameter slightly less than the bore of the sub 32 can be pumped through the reeled tubing 20 and into the sub 32 where it engages the corresponding end of the prop 36. This seals off the prop 36, allows fluid pressure to build up above the ball and forces it and the prop 36 in a direction from left-to-right as viewed in FIG. 2 until the pins 38 shear. The prop 36 then moves relative to the subs 32 and 34 until the shoulder 36*a* of the prop 36 engages the shoulder 32*g* of the sub 32. Since the seal ring 40*a* moves past the opening 32*d* and 32*f*, the latter openings allow the fluid pressure within the reeled tubing 20 to equalize with the fluid pressure within the tubing 16 which gives the reeled tubing operator an indication that the connecting device 30 has been activated. In this position, the groove 36*b* aligns with the lugs 42 which allows the lugs to move into the groove. The fishneck 34*b* is thus released from the lugs 42 and the sub 32 can move in an axial direction away from the sub 34, permitting a quick disconnect of the reeled tubing 20 from the operating tool 26. During this operation the weep opening 36*c* permits any fluid trapped in the space between the shoulders 36*a* and 32*g* and in the groove 36*b* of the prop 36 to pass into the bore of the prop 36. Also, the retaining ring 43 limits movement of the prop 36 relative to the sub 32, thus preventing the lugs 42 from falling out of their respective openings in the sub 32.

The openings 32*d* and 32*f* also allow some fluid circulation to occur while the reeled tubing, and therefore the sub 32 and the prop 36, are pulled out of the well 14 to prevent debris from settling around the reeled tubing 20. The reeled tubing 20, the sub 32 and the prop 36 can then be removed from the well, leaving the sub 34 including the exposed fishneck 34*b*. A pulling tool, or the like, can then be inserted into the well tubing 16 to engage the fishneck 34*b* for the purpose of releasing the tool 26.

The embodiment of FIGS. 5 and 6 is similar to the embodiment of FIGS. 2–4 and identical components are given the same reference numerals. According to the embodiment of FIGS. 5 and 6, a device 30′ is shown which is identical to the device 30 of the previous embodiment with the exception that the device 30′ includes a sub 32′, a prop 36′ and a sub 34′ having a fishneck 34*b*′ all of which have an increased axial length when compared to the subs, prop and fishneck of the previous embodiment. Also, a portion of the internal surface of the sub 34′ and a corresponding portion of the external surface of the sub 32′ are provided with a plurality of cooperating angularly-spaced grooves and lands referred to in general by the reference numeral 50 in FIG. 6. In the connected position of FIGS. 5 and 6, the lands 50 of the sub 32′ engage the grooves 50 of the sub 34′, and vice versa. Thus, any torque applied to the sub 34′ is transferred to the sub 32′, as in the previous embodiment. Otherwise the embodiment of FIGS. 5 and 6 is identical to that of FIGS. 2–4.

It is thus seen that the device of the present invention provides an efficient and reliable technique for connecting the reeled tubing 20 to the operating tool 26 while preventing any free wheeling, yet permitting a quick and easy release of the reeled tubing from the tool.

It is understood that the device of the present invention is not limited to use with reeled tubing and a rotating tool but can be used in connection with other downhole equipment such as a hydraulic workover unit used for drilling or milling, as described above. In the latter case, the connecting device of the present invention would be connected between two adjacent tubular members, preferably near the end of the spring of tubular members that is connected to the drilling or milling tool, to transfer torque from the other end of the string to the latter tool, while permitting a release in the case a drill or milling bit becomes jammed.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A device for connecting a first tubular member to a second tubular member for operating in an earth well, said device comprising a first tubular body member having a longitudinal bore extending therethrough, means for connecting said first body member to one of said tubular members, a second tubular body member having a longitudinal bore extending therethrough, means for connecting said second body member to the other tubular member, means for connecting said second body member to said first body member while preventing relative rotational movement therebetween, and means for releasing said second body member from said first body member in said well.

2. The device of claim 1 wherein said means for connecting said first body member to said second body member comprises a fishneck formed on one of said body members, and at least one lug member slidibly mounted on the other body member and adapted to engage said fishneck.

3. The device of claim 2 where said means for connecting said first body member to said second body member further comprises aligned grooves formed in said body members, and a bar disposed in said grooves for preventing said rotational movement.

4. The device of claim 2 wherein said means for connecting said first body member to said second body member further comprises cooperating lands and grooves found on said body members and adopted to engage for preventing said rotational movement.

5. The device of claim 1 wherein said bores of said first and second body members together define a continuous bore for passing fluid.

6. The device of claim 5 wherein on of said members is reeled tubing for receiving a fluid and the other member is a tool having a rotatable component.

7. The device of claim 5 wherein said releasing means comprises means for increasing the fluid pressure in one of said bores and means responsive to a predetermined fluid pressure in said one bore for disengaging said lug member from said fishneck.

8. The device of claim 7 wherein said releasing means further comprises a tubular prop member disposed in said continuous bore and defining a bore for passing said fluid, said prop member adapted to move axially in said continuous bore in response to said predetermined fluid pressure.

9. The device of claim 8 further comprising means responsive to said axial movement of said prop member for releasing said fluid pressure to equalize the pressure within the reeled tubing with the fluid in the well.

10. A device for connecting a first tubular member to a second tubular member for operating in an earth well, said device comprising a first tubular body member, means for connecting said first body member to one of said tubular members, a second tubular body member, means for connecting said second body member to the other tubular member, means for connecting said first body member to said second body member in a manner to prevent axial movement therebetween, means for connecting said first body member to said second body member in a manner to transmit rotational movement therebetween, and means for releasing said connections in said well.

11. The device of claim 10 wherein said bores of said first and second body members together define a continuous bore for passing fluid.

12. The device of claim 10 wherein each of said body members has a longitudinal bore formed therethrough which are aligned when said body members are connected to transfer fluid from said reeled tubing to said tool.

13. The device of claim 12 wherein said releasing means further comprises a tubular prop member disposed in said continuous bore and defining a bore for passing said fluid, said prop member adapted to move axially in said continuous bore in response to said predetermined fluid pressure.

14. The device of claim 13 further comprising means responsive to said axial movement of said prop member for releasing said fluid pressure to equalize the pressure within the reeled tubing with the fluid in the well.

15. The device of claim 12 wherein said releasing means comprises means for increasing the fluid pressure in one of said bores and means responsive to a predetermined fluid pressure in said one bore for disengaging said lug member from said fishneck.

16. The device of claim 10 wherein said means for connecting said first body member to said second body member in a manner to prevent said axial movement comprises a fishneck formed on one of said body members, and at least one lug member slidibly mounted on the other body member and adopted to engage said fishneck.

17. The device of claim 10 where said means for connecting said first body member to s id second body member in a manner to prevent said rotational movement comprises aligned grooves formed in said body members, and a bar disposed in said grooves.

18. The device of claim 10 wherein said means for connecting said first body member to said second body member in a manner to prevent said rotational movement comprises cooperating angularly-spaced lands and grooves on said body members, the lands of each body member adapted to engage the grooves of the other body member.

* * * * *